US005709153A

United States Patent [19]

Brandt

[11] Patent Number: 5,709,153

[45] Date of Patent: Jan. 20, 1998

[54] HIGH DOG INDEXER

[75] Inventor: Calvin Brandt, Plymouth, Minn.

[73] Assignee: Motion Controls, Inc., Minneapolis, Minn.

[21] Appl. No.: 580,810

[22] Filed: Dec. 29, 1995

[51] Int. Cl.[6] ..... B61J 3/04

[52] U.S. Cl. ..... 104/162; 104/176; 198/746

[58] Field of Search ..... 104/162, 176, 104/172.3; 198/743, 744, 746

[56] References Cited

U.S. PATENT DOCUMENTS

| | | | |
|---|---|---|---|
| 2,767,622 | 10/1956 | Howard et al. | 104/176 |
| 3,191,919 | 6/1965 | Acker | 198/744 |
| 3,348,498 | 10/1967 | Ames et al. | 104/176 |
| 3,508,499 | 4/1970 | Collins | 104/176 |
| 3,522,772 | 8/1970 | Hunt | 104/162 |
| 3,696,754 | 10/1972 | Anderson et al. | 104/102 |
| 3,922,007 | 11/1975 | Friedebach | 280/447 |
| 4,006,691 | 2/1977 | Kacir et al. | 104/176 |
| 4,252,064 | 2/1981 | Roteliff, Jr. et al. | 104/162 |
| 4,354,792 | 10/1982 | Cornish | 104/176 |
| 4,926,755 | 5/1990 | Seiford, Sr. | 104/183 |

OTHER PUBLICATIONS

"Stamler Railroad Car Spotters For Efficient Bulk Loading/Unloading Operations"; W.R. Stamler Corporation; Publication 1990.

"Wolan HCM Hydraulic Car Mover"; The Nolan Company Publication–Date Unknown.

*Primary Examiner*—S. Joseph Morano

*Attorney, Agent, or Firm*—Haugen and Nikolai, P.A.

[57] ABSTRACT

Railway car indexers are disclosed that include a high dog engaging member for engaging a bogey frame behind a railway axle. The high dog is pivotally attached to a dog carriage which is slidably inserted in an indexer track juxtaposed to the railroad track. The high dog is actuated between a raised and a lowered position by a lever arm which is pivotally attached to the dog carriage and a spring-piston cylinder connected to the high dog and the lever arm. The dog carriage is moved back and forth in the indexer track to engage the lever arm and high dog with the bogey frame to move the railway cars. In a reversing indexer, the dog carriage includes opposing high dogs for engaging the bogey frame behind either axle for moving the railway cars in either direction. The single direction or reversing direction indexers include a dog carriage on one or both sides of the railroad track. The spring-piston cylinder is built to urge the high dog to the raised position or the lowered position without damaging the dog carriage if the high dog is prevented from moving.

13 Claims, 9 Drawing Sheets

HIGH DOG INDEXER

BACKGROUND OF THE INVENTION

I. Field of the Invention

This invention relates generally to railway car handling equipment and, more particularly, to a railway car indexer which positions railway cars along a railroad track during unloading operations.

II. Discussion of the Related Art

Freight hauling railway cars are positioned near freight or cargo handling equipment during loading and unloading operations. Freight in the form of bulk cargo such as grain, coal, iron or the like is typically lifted or dumped into railway cars or emptied out of the railway cars using stationary freight handling equipment such as chutes and conveyor equipment. Liquid bulk cargo is typically unloaded by opening drain valves connected to large hoses and associated pumping equipment. Coal gondolas and cars for transporting grain or other finely divided dry bulk agriculture material are cars which may be covered and which have a plurality of spaced bottom discharge hopper bins or chutes accessing the main storage volume and closed by discharge gates. These are designed to be positioned over dedicated recessed receiving facilities situated at fixed stations, such as grain or coal bins and conveyors positioned beneath the railroad track.

In the discharge operation, a connected train engine roughly positions one end of a string of cars to be unloaded over the receptacle. However, train engines are not well suited for indexing or precisely positioning individual cars or even sets of cars along the railroad track, let alone over individual car bins. To this end, positioning devices known as railway car indexers or positioners have been built and operated at fixed stations.

Railway car indexers include at least one engaging member or "dog" for engaging at least one railway car in a string of cars and moving the string a given distance along the railroad track. The engaging member is often situated and operated along an auxiliary indexer track or guideway juxtaposed in parallel relation to the railroad track in the fixed receiving facility. Fluid-operated actuators, such as hydraulic cylinders, or chains and sprockets driven by hydraulic or electrical motors supply power for moving the member and railway cars.

U.S. Pat. Nos. 4,006,691 issued to Kacir et al. and 4,354,792 issued to Cornish show train positioners including an engaging member arm which engages a car coupler from above. The engaging member arm is situated on a positioner track or guideway next to the railroad track. Power is supplied to the positioner for moving the railway cars by a motor connected to a pulley and cable assembly. These positioners are quite large and complex, and initially aligning the railway cars with the engaging member arm such that the arm may be lowered to engage the car coupler may be difficult.

A smaller and less complex type apparatus that has been used for indexing railway cars includes a car engaging member arm or "dog" which is built to engage either the railway bogey wheel truck frame, or an axle. The dog is smaller than the car coupler engaging arm and situated either between the rails of the railroad track to engage the axle or next to the railroad track to engage the truck frame.

U.S. Pat. Nos. 3,696,754, issued to Anderson et al. and 4,252,064 issued to Ratcliff, Jr. et al., describe car shifting systems including an axle engaging dog pivotally attached to a dog carriage or barney which is situated in a guideway positioned between the rails of the railroad track. The dog is spring biased to a raised position for engaging the railway wheel axle as the barney is moved in one direction along the guideway by an hydraulic cylinder. The dog in the '754 patent is pivoted to a lowered position if hit from behind and the dog in the '064 patent is pivoted to a lowered position by extending an hydraulic cylinder. Railway car indexers including a central axle engaging dog advantageously do not apply a rotational force to the bogey wheel truck frame and, thus, tend not to derail even empty railway cars. However, a centrally located indexer may interfere with the unloading operations of a bottom unloading railway car, such as a grain hauling railway car. Furthermore, an indexer which moves railway cars in either direction may be needed.

U.S. Pat. No. 4,926,755, issued to Seiford, Sr., describes a reversing railway car moving system including a double truck assembly which operates in a guide track alongside the railroad track. Each truck of the double truck assembly includes two engaging members which are hinged together and spring biased to a raised position to form a peak at the hinge. In the raised position, the two trucks form a valley in which the bogey wheel truck frame is engaged on the lower portion for movement in either direction. An hydraulic cylinder in each truck is extended to lower the engaging members such that a railway car may freely pass over the double truck assembly. This reversing railway car moving system is powered by a cable and winch, and a double truck assembly may be positioned on one or both sides of the railroad track. Railway car indexers including a low dog which engages the lower portion of the truck frame work fine if the railway car is loaded to provide downward acting forces on the truck frame to prevent derailing. However, low dog engaging members may tend to lift the truck frame from the railroad track if the railway car is empty. A railway car indexer advantageously situated alongside the railroad track and which does not tend to derail empty railway cars would present a desired improvement.

OBJECTS

It is accordingly a principle object of the invention to provide an improved railway car indexer.

Another object of the invention is to provide an improved reversing railway car indexer.

Yet another object of the invention is to provide an improved railway car indexer which engages a bogey wheel truck frame.

Still another object of the invention is to provide an improved railway car indexer including a high dog which eliminates the tendency to derail even an empty railway car.

Still yet another object of the invention is to provide a railway car indexer including a high dog for engaging the bogey wheel truck frame behind the railway wheel axle.

A further object of the invention is to provide a railway car indexer including a high dog on each side of the railroad track for engaging each side of the bogey wheel truck frame behind the railway wheel axle.

A still further object of the invention is to provide a railway car indexer including a high dog on each side of the railroad track wherein the high dogs are moved simultaneously to move the engaged railway wheel truck frame with balanced force.

A yet still further object of the invention is to provide an improved actuator for operating a high dog between a raised position and a lowered position.

An additional object of the invention is to provide an improved actuator including a lever arm pivotally attached to the dog carriage and connected to a spring-piston cylinder which is connected to the high dog such that the high dog moves between a raised and a lowered position by pivoting the lever arm.

A further additional object of the invention is to provide a spring-piston cylinder which urges the high dog between the raised and lowered positions and acts as a safety system to absorb the pivoting motion of the lever arm if the high dog is prevented from being raised or lowered.

Other objects, features and advantages of the present invention will become apparent to those skilled in the art through familiarity with the summary of the invention, detailed description, claims, and drawings herein.

SUMMARY OF THE INVENTION

The foregoing objects of the present invention are among those attained by providing an improved railway car indexer which includes a high dog engaging member for engaging a bogey wheel truck frame behind a railway wheel axle. The high dog is pivotally attached to a dog carriage which operates in an indexer track juxtaposed to a railroad track. In a reversing indexer, the dog carriage includes opposing high dogs for engaging the truck frame behind either axle. Dog carriages may be positioned on one or both sides of the railroad track wherein movement of the dog carriages may be coordinated such that the high dogs engage and move the railway car together. The present invention includes both single direction and reversing direction indexer embodiments.

Each high dog is operated between a raised and a lowered position by a dedicated mechanical actuator carried by the dog carriage. The actuator includes a lever arm and a spring biased or operated piston cylinder arrangement wherein the lever arm is pivotally attached to the dog carriage spaced from the high dog. The spring-piston cylinder is connected to the lever arm and the high dog to transfer pivoting forces from the lever arm to the high dog. The lever arm includes a rotatably attached roller which engages objects, such as the lower portion of the bogey wheel truck frame, to pivot the lever arm and apply pivoting forces to the spring-piston cylinder and the high dog.

The spring-piston cylinder of the present invention, includes a rod slidably inserted in an outer casing and securely attached to a rod piston. The rod and the outer casing are connected to the lever arm and the dog, respectively. A neutral spring and a dog lift spring are disposed in the outer casing and separated by the rod piston and a floating piston. The rod is slidably inserted through the dog lift spring and the floating piston such that the floating piston is engaged between the rod piston and the dog lift spring which, in turn, is engaged between the floating piston and the rod end of the outer casing. The neutral spring is engaged between the rod piston and the butt or cylinder end of the outer casing. In a neutral position (no forces applied to the lever arm roller), the lever arm is held near vertical by the spring-piston cylinder and the dog is in the lowered position. Pivoting the lever arm moves the rod in or out of the outer casing to force the rod piston to engage the neutral spring or the floating piston and dog lift spring. This transfers pivoting forces from the lever arm through the rod and the neutral or dog lift spring to the outer casing and the dog.

The dog carriage of the present invention is slidably engaged on a dog carriage indexer track or guideway situated alongside the railroad track. The dog carriage is connected to a chain which meshes with a drive sprocket at one end of the indexer track and an idler gear at the other end. The drive sprocket is powered by a prime mover, such as an hydraulic or electric motor, which is controlled to move the dog carriage in either direction along the indexer track. If dog carriages are provided on both sides of the railroad track, then each side is driven by a single motor or, as in the example described herein, each is driven by an independent motor wherein power to the motors is controlled to simultaneously apply moving forces to each side of the bogey wheel truck frame. Of course, the high dog carriage may be moved by other means including fluid operated actuators, such as hydraulic cylinders or telescoping hydraulic cylinders, a chain and sprocket system or electrical motor drives.

In operation, a dog carriage is moved along the indexer track to engage a railway car in a train of railway cars which was previously rolled into the fixed station. To index the railway cars, the dog carriage is moved to engage the operating lever arm roller on the undercarriage or lower portion of the bogey wheel truck frame. From the neutral (up) position, the lever arm roller is pushed toward the dog by the truck frame pivoting the lever arm and urging (extending) the connected rod out of the spring-piston cylinder. The rod piston engages the floating piston which engages the dog lift spring to transfer the pivoting forces from the lever arm to the rod end of the outer casing. This pulls on the butt end to pivot the dog to the raised position for engaging the bogey wheel truck frame behind the railway wheel axle. Once the car is engaged, the dog carriage is moved further in the same direction to position or index the engaged one of the string of railway cars for loading or unloading operations. If the dog is prevented from pivoting to the raised position, the dog lift spring compresses to absorb the pivoting action of the lever arm and prevent damage to the dog carriage.

To move the train of railway cars further in the same direction, the dog carriage is moved in the reverse direction to reposition the dog carriage behind another bogey wheel truck frame of interest. In a single direction indexer, the dog carriage passes easily under any number of truck frames in the reverse direction. The lever arm roller returns to the neutral position as the dog carriage is moved away from the first truck frame of interest. This returns the high dog to a lowered position. As the dog carriage passes under the next bogey wheel truck frame, the lever arm roller is pushed away from the high dog and the rod is urged into the spring-piston cylinder. This forces the rod piston to engage the neutral spring which, in turn, engages the butt end of the outer casing to hold the dog in the lowered position. Thus, the dog carriage may be reversed under any number of truck frames to position it for moving the train further in the same direction.

In a reversing indexer embodiment, the dog carriage includes an opposing lever arm and high dog combination pivotally attached to the dog carriage such that the lower portion of the truck frame fits between the two lever arms in their neutral positions. The high dogs are pivotally attached to the dog carriage outside and next to their corresponding lever arms. From this position, if the dog carriage is moved in either direction, then one of the two lever arm rollers is pushed toward its connected dog to pivot the dog to the raised position. To index railway cars further in one direction, the dog carriage is moved to position the opposing roller of the opposing lever arm in an elongated dog house or rectangular box having a lid provided which pushes the opposing roller away from its dog and locks the dog in the lowered position. At the same time, the lower portion of the truck frame near this opposing roller is positioned above the dog house. The direction of travel of the dog carriage is reversed to release the engaging lever arm roller from under the truck frame and the opposing roller from the dog house to under the truck frame. The opposing roller is still held away from its dog by the truck frame to hold the dog in the lowered position. The dog carriage is reversed further to free both rollers from the truck frame and return them to their neutral positions. The dog carriage is reversed until the next truck frame is engaged between the lever arms as the first dog and roller pass under the truck frame and the opposing roller prevents the dog carriage from freely passing further in the reverse direction. The dog carriage and railway cars are then moved in the desired direction.

A lock down bar is also provided along the indexer track for holding the lever arm roller away from the high dog to lock the dog in the lowered position. When the lock down bar is in use, railway cars can freely pass in either direction along the railroad track.

DETAILED DESCRIPTION

Figure 1:
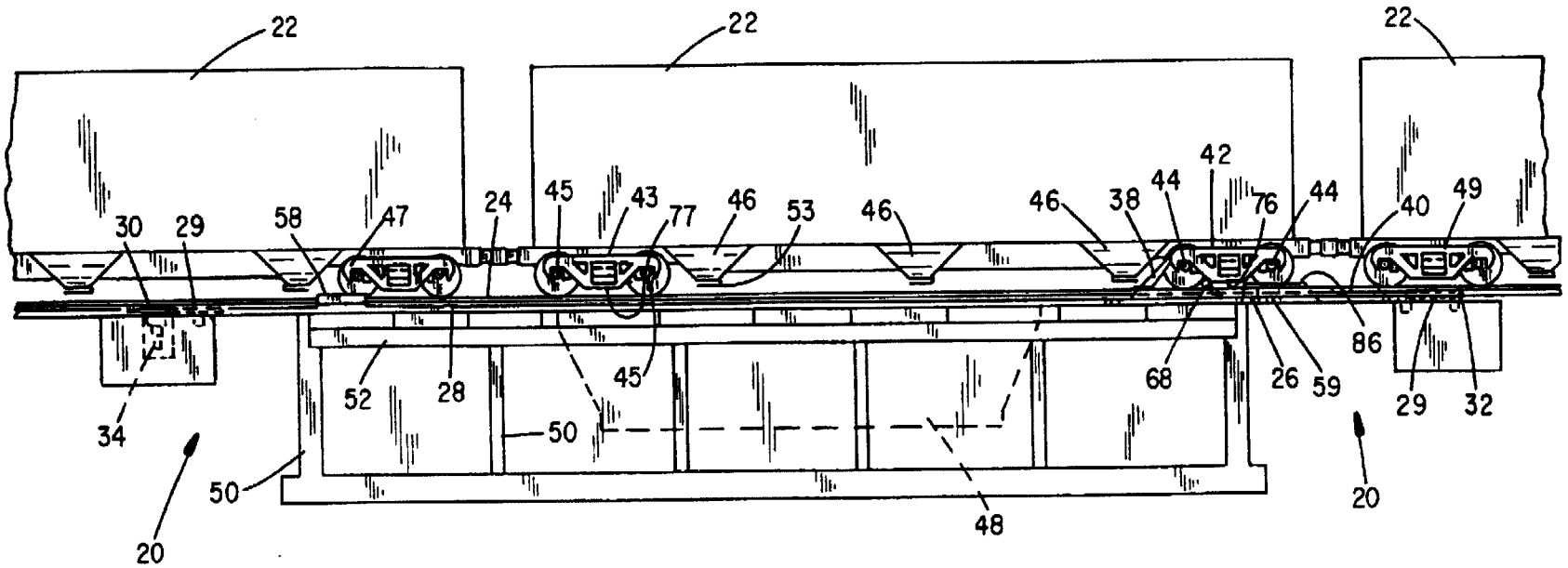
FIG. 1 is a partial sectional side view of a reversing high dog indexer of the present invention at a fixed station for unloading bottom unloading railway cars.
Figure 2:
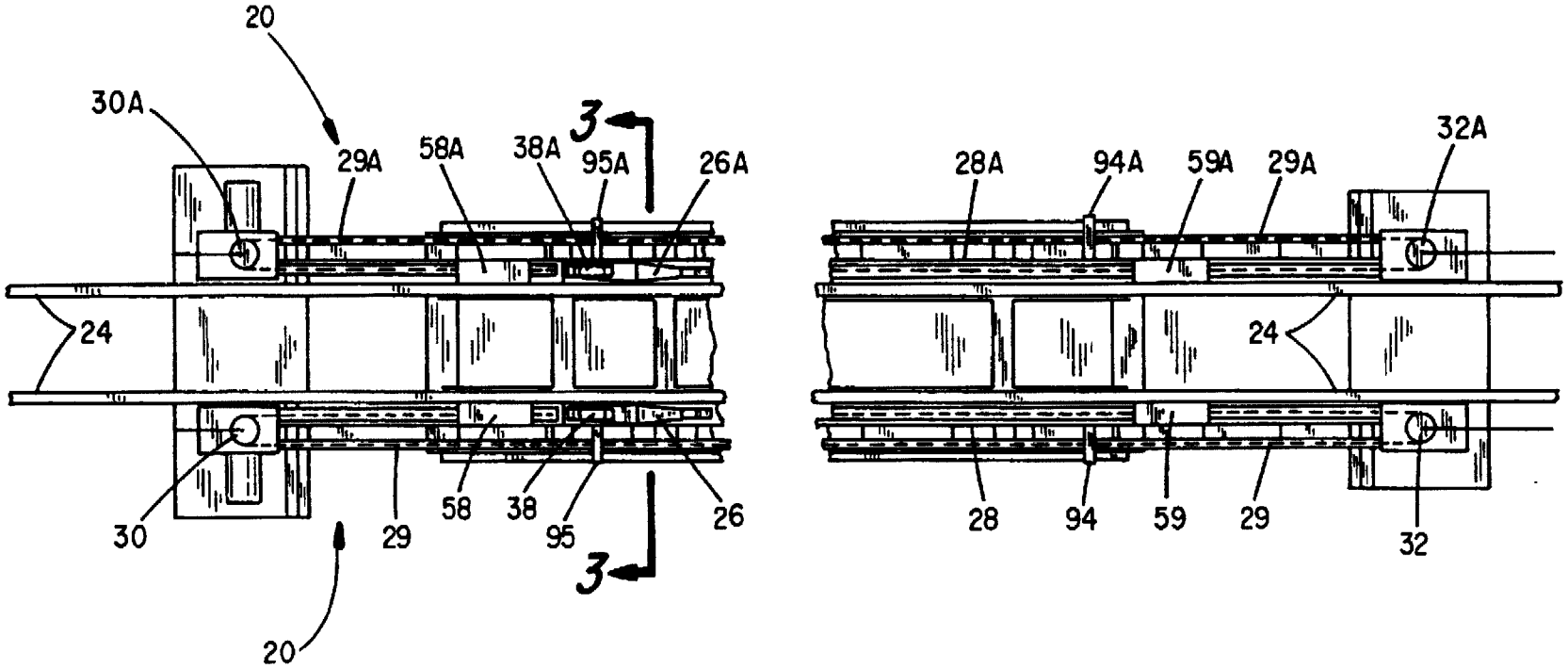
FIG. 2 is a fractured top plan view of the high dog indexer of FIG. 1 without the railway cars.
Figure 3:
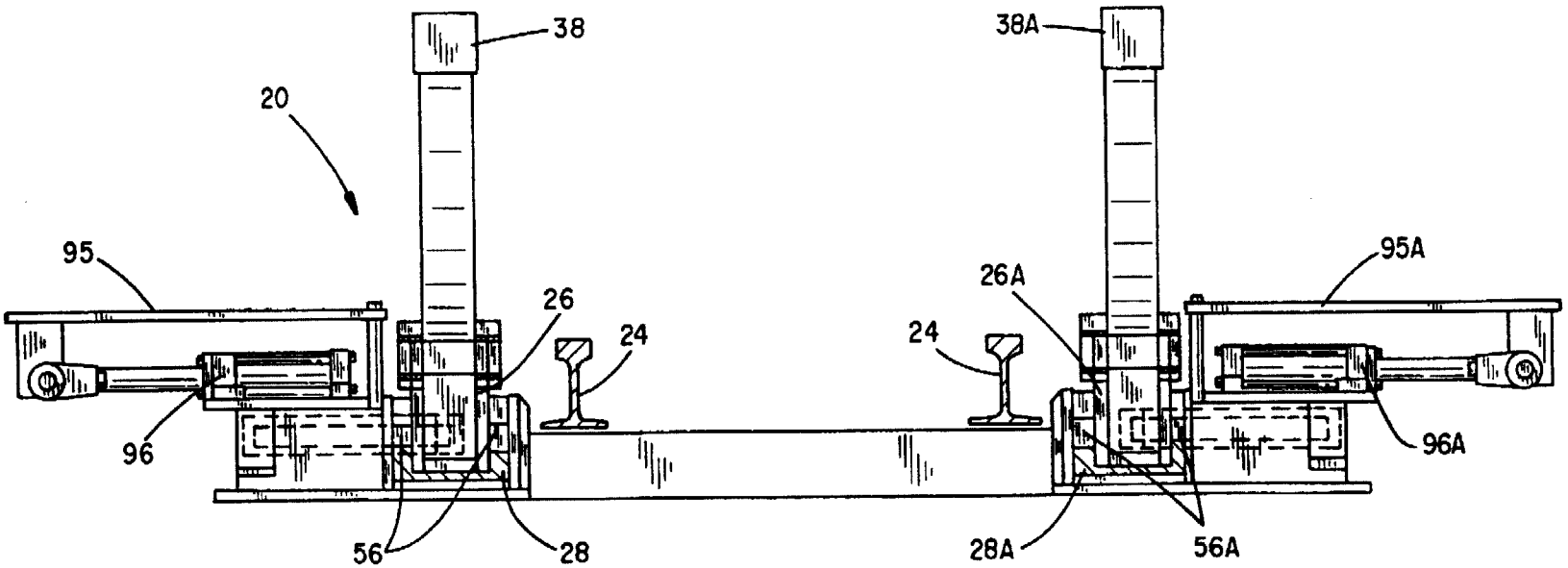
FIG. 3 is a sectional view taken substantially along the line 3—3 in FIG. 2 showing the high dogs in the raised position and lock down bars in the unlocked position.

One embodiment of the high dog indexer of the present invention, as shown in FIGS. 1–3 and indicated generally by the numeral 20, is a reversing indexer situated for moving a train of connected bottom unloading railway cars 22 along a railroad track 24 in either direction. As seen in FIGS. 2 and 3, the high dog indexer 20 includes dog carriages 26 and 26A slidably engaged in indexer tracks 28 and 28A situated alongside the railroad track 24. The dog carriages 26 and 26A are securely attached to heavy chains 29 and 29A which engage drive sprockets or gears 30 and 30A and idler gears 32 and 32A. Drive motors, as at 34, such as electric or hydraulic motors, rotate the drive gears 30 and 30A to move the dog carriages 26 and 26A between the ends of the high dog indexer 20.

Opposed dog carriages 26 and 26A are structurally the same and include high dog engaging members as at 38 and 40, FIG. 1, which are pivotally attached to the dog carriage 26 for pivoting between a raised position, as at 38, and a lowered position, as at 40. In the raised position, the high dog engaging members 38 and 40 are positioned to engage the bogey wheel truck frame, as at 42, behind one of the railway wheel axles 44. The railway cars 22 are moved along the railroad track 24 as the dog carriage 26 is moved between the ends of the high dog indexer 20. Movement of the dog carriage 26 is used to position the bottom unloading chutes 46 of the railway cars 22 over a receptacle 48 situated underneath the railroad track 24.

The railroad track 24 and the receptacle or chute 48 are supported in the unloading area or fixed station by a bridge or support frame of heavy structural members 50 and 52 made of a suitable material, such as concrete or steel, and provided with suitable footings. Gates as at 53 are opened and the freight, such as grain, falls through the bin chute 48 to a means for carrying it away, such as a conveyor belt (not shown). Of course, the high dog indexer 20 may be used for moving any type of railway car along a railroad track for any purpose, including loading and unloading the railway car.

As FIGS. 2 and 3 also show, the dog carriages 26 and 26A include slide bars 56 and 56a slidably inserted in the indexer tracks 28 and 28A which are seated slightly lower than the railroad track 24 such that the top of the dog carriages 26 and 26A are slightly higher than the top of the railroad track 24. In the lowered position, railway cars freely pass over the dog carriages 26 and 26A. In the raised position, the high dogs, as at 38 and 38A, are positioned to engage the bogey wheel truck frame 42 behind one of the railway wheel axles 44.

Figure 4:
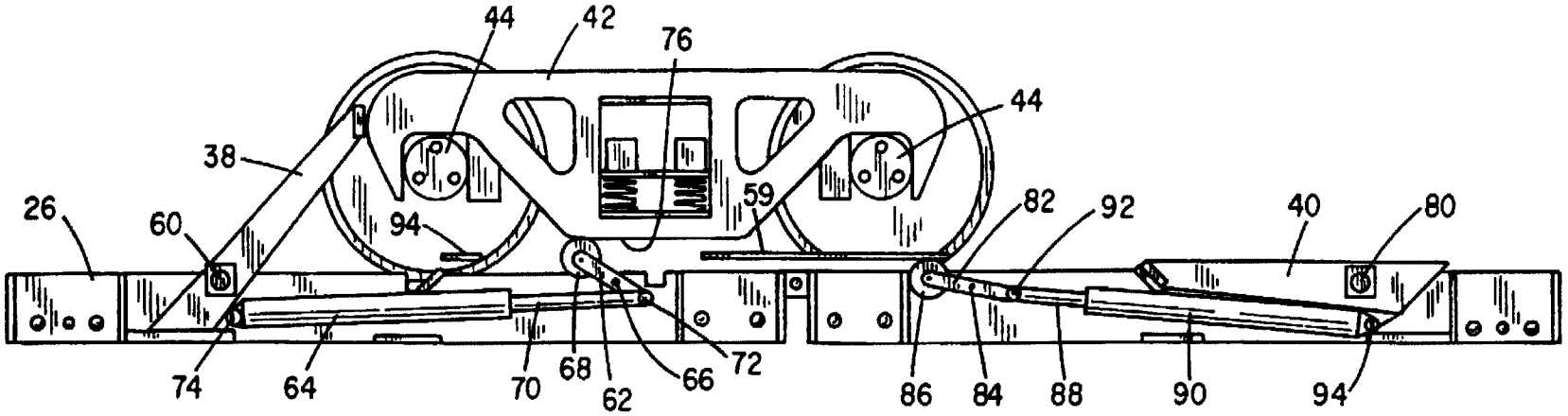
FIG. 4 is an enlarged, side view partially in section of the reversing indexer dog carriage engaging a bogey wheel truck frame in the forward most position.

The dog carriages 26 and 26A are structurally the same and, as shown in FIG. 4, include high dogs 38 and 40 pivotally attached to opposite ends of the dog carriage 26 at 60 and 80, respectively. The high dogs 38 and 40 are operated between the raised and the lowered positions by lever arms 62 and 82 and spring-piston cylinders 64 and 90. The lever arms 62 and 82 are pivotally attached to the dog carriage 26 at 66 and 84 and include rotatably attached rollers 68 and 86 which engage a lower portion 76 of the bogey wheel truck frame member 42. The rollers 68 and 86 are pushed toward or away from the corresponding high dog 38 and 40 as the dog carriage 26 moves in relation to the truck frame 42. Spring-piston cylinder rods 70 and 88 are pivotally connected to the lever arms 62 and 82 at 72 and 92 and the spring-piston cylinders 64 and 90 are pivotally attached to the dogs 38 and 40 at 74 and 94. As explained below, pushing the rollers 68 and 86 away from the dogs 38 and 40 forces the rods 70 and 88 into the spring-piston cylinder 64 and 90 and urges the respective dog 38 or 40 to the lowered position. Moving the rollers 68 and 86 toward the dogs 38 and 40 urges the rods 70 and 88 out of the spring-piston cylinders 64 and 90 and pivots the dogs 38 and 40 to the raised position. In the raised position, the dog carriage 26 may be moved to force the dog 38 or 40 against the truck frame 42 and move the railway cars 22 along the railroad track 24. Rollers 68 and 86 are also positioned to engage dog houses, such as at 59, and lock down bars, as at 94.

As is also shown in FIGS. 2–4, dog houses 58, 58A, 59 and 59A are situated over the indexer tracks 28 and 28A. The dog houses 58, 58A, 59 and 59A are rectangular boxes having open ends positioned over the indexer tracks 28 and 28A such that the dog carriages 26 and 26A can slide into them in the lowered position.

The lock down bars 94, 94A, 95 and 95A are stationarily positioned along the indexer tracks 28 and 28A such that the bars, as at 95 and 95A (FIG. 3) are above the dog carriages 26 and 26A. The lock down bars 95 and 95A are connected to fluid operated actuators 96 and 96A, such as hydraulic cylinders, which are operated between a retracted or lock down position and an extended or unlocked position. The look down bars 94, 94A, 95 and 95A are structurally similar and operate in the same manner. In the lock down position, the lock down bar 94 (FIG. 4) is positioned to engage the lever arm rollers 68 and 86 to operate the dogs 38 and 40 between the raised and lowered positions as the dog carriage 26 is moved relative to the lock down bar 94. In use, the lock down bar 94 is moved to the lock down position to hold either roller 68 or 86 away from the respective dog 38 or 40 and lock the dog 38 or 40 in the lowered position to allow trains to pass freely over the high dog indexer 20.

Figure 5:
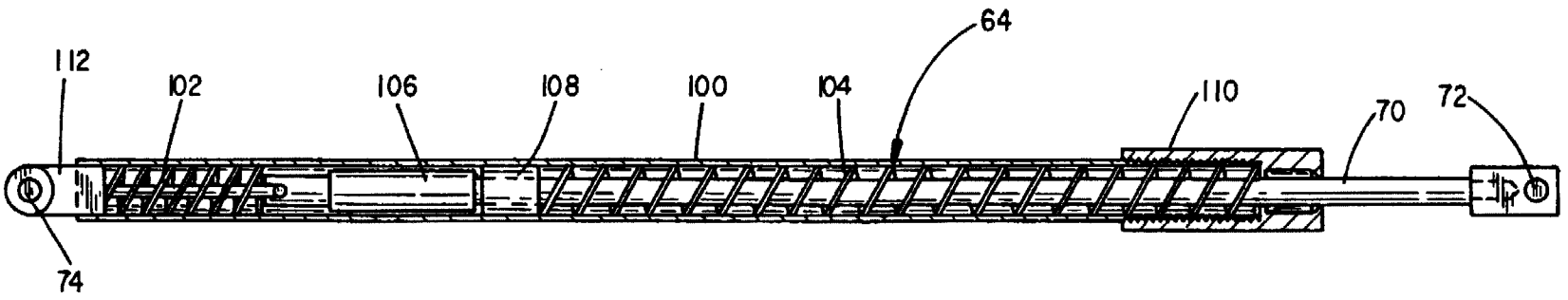
FIG. 5 is a greatly enlarged sectional side view of a spring-piston cylinder of the present invention.

The spring-piston cylinders 64 and 90 are structurally the same and, as shown in FIG. 5, spring-piston cylinder 64 includes an outer casing 100 which houses a neutral spring 102 and a dog lift spring 104 separated by a rod piston 106 and a floating piston 108. End cap 110 is threaded onto outer casing 100 to engage the dog lift spring 104 and butt end cap 112 is securely attached to the outer casing 100 to engage the neutral spring 102. The cylinder rod 70 is securely attached to the rod piston 106 and slidably inserted through the floating piston 108 and dog lift spring 104 through the end cap 110. The rod piston 106 is situated between the neutral spring 102 and the floating piston 108. The floating piston 108 slides inside the outer case 100 to force the dog lift spring 104 against the end cap 110 as the rod 70 is urged out of the outer casing 100 by pivoting the lever arm roller 68 (FIG. 4) toward the high dog 38. This pulls on the outer casing 100 and butt end cap 112 to pivot the dog 30 to the raised position. Urging the rod 70 into the outer casing 100, moves the rod piston 106 against the neutral spring 102 which forces the butt end 112 toward the pivotable connection 74 to urge the dog 38 to the lowered position.

Figure 6:
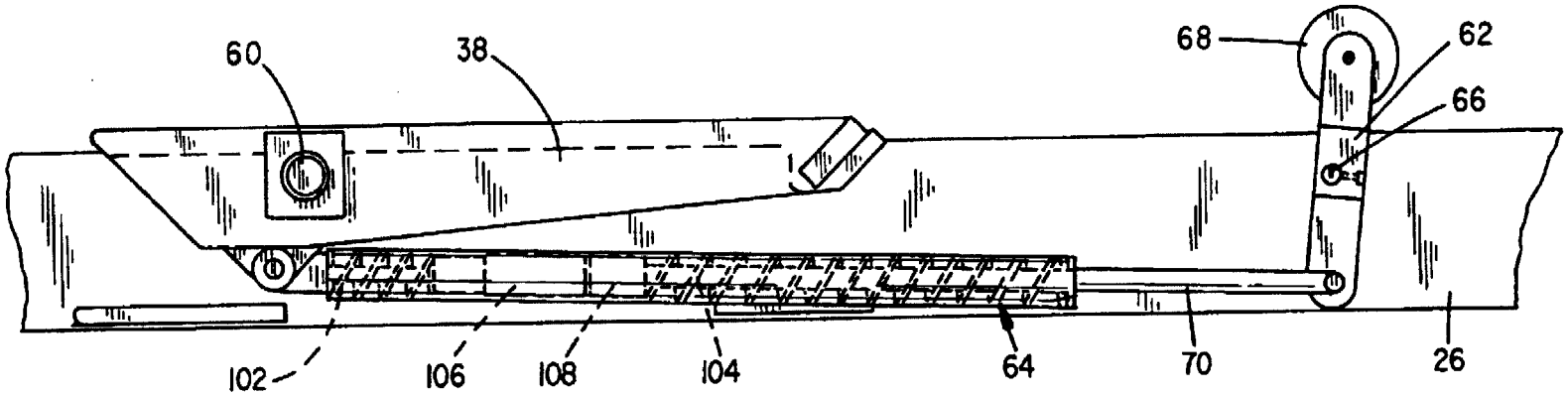
FIG. 6 is a greatly enlarged, fragmentary side view partially in section of one portion of the reversing indexer dog carriage shown in a neutral position.
Figure 7:
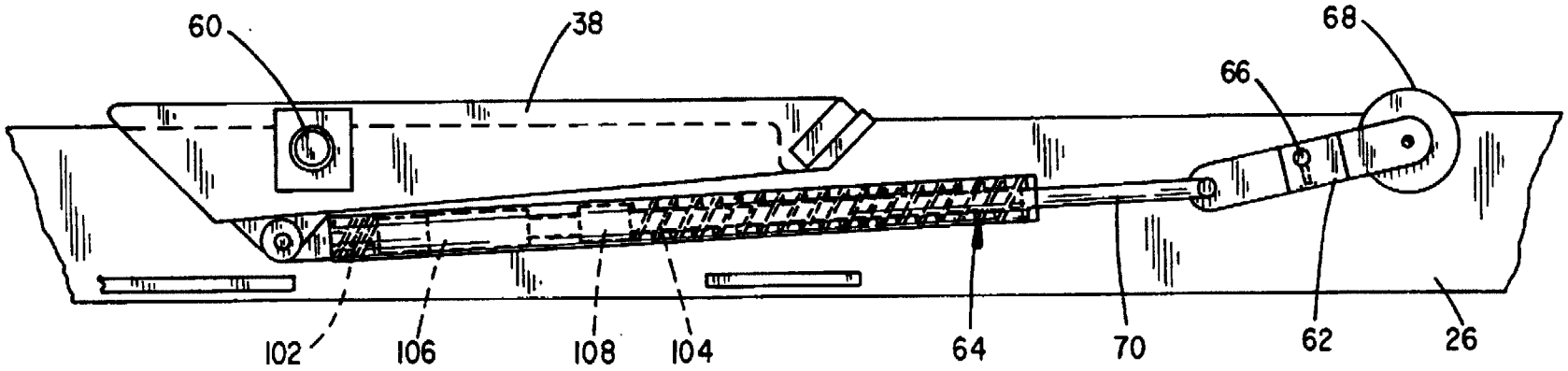
FIG. 7 is a greatly enlarged, fragmentary side view partially in section of one portion of the reversing indexer dog carriage shown in a locked down position.
Figure 8:
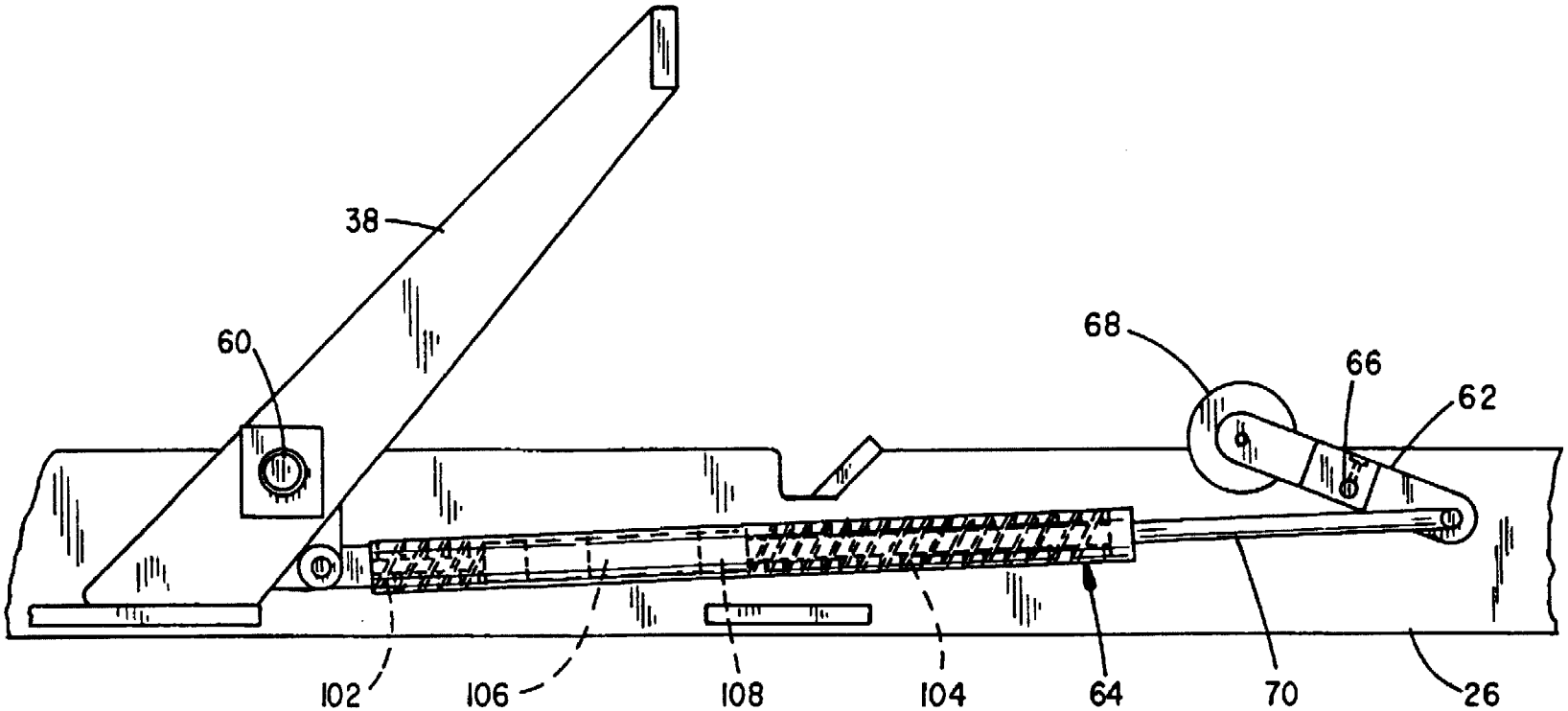
FIG. 8 is a greatly enlarged, fragmentary side view partially in section of one portion of the reversing indexer dog carriage shown in a raised position.

As shown in FIGS. 6–9, the spring-piston cylinder 64 and the lever arm 62 operate the dog 38 between the lowered and the raised positions. In FIG. 6, the spring-piston cylinder 64 and the lever arm 62 are in a neutral position wherein no forces are applied to the lever arm 62 which is in a standing position. From this position, the rod 70 is urged into the spring-piston cylinder 64 to maintain the dog 38 in the lowered position by moving roller 68 away from the dog 38 to pivot the lever arm 62 about pivot 66. This, in turn, forces the rod piston 106 to compress the neutral spring 102 and urge the dog 38 to pivot about 60 to maintain the dog 38 in the lowered position, FIG. 7. To raise the dog 38, the roller 68 is moved toward the dog 38 to pivot the lever arm 62 about pivot 66 and urge the rod 70 out of the spring-piston cylinder 64. This pulls the rod piston 106 against the floating piston 108 which engages the dog lift spring 104 to pivot the high dog 38 to the raised position about pivot 60, FIG. 8.

Figure 9:
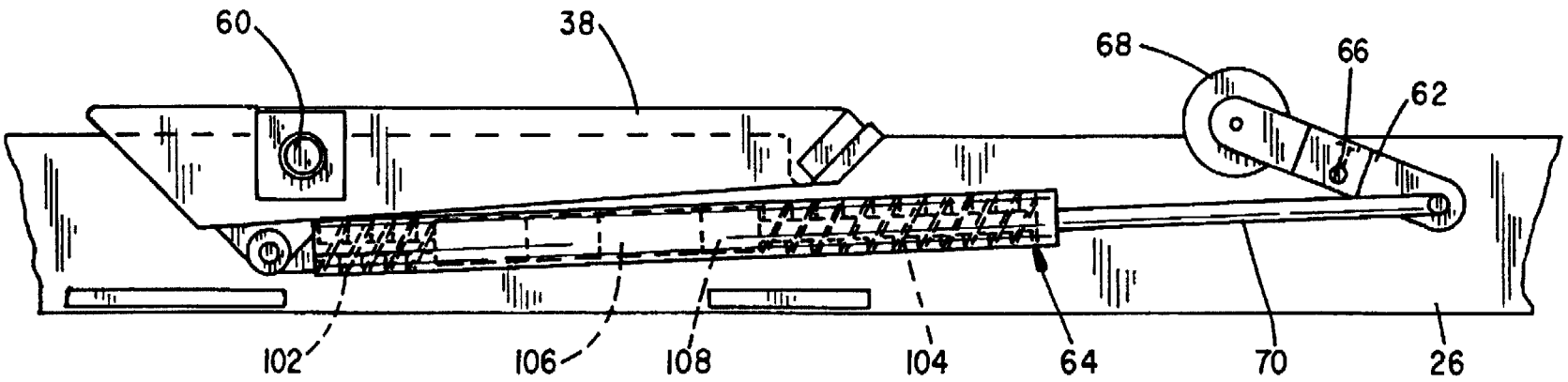
FIG. 9 is a greatly enlarged, fragmentary side view partially in section of one portion of the reversing indexer dog carriage wherein the lever arm is in the raised position and the high dog is prevented from being raised.

As shown in FIG. 9, if the dog 38 is prevented from being raised, such as by part of the railway car (not shown), then the dog lift spring 104 compresses to absorb the forces applied by the roller 68 and lever arm 62. In a similar manner, if the high dog 38 cannot be lowered from the raised position, then the neutral spring 102 absorbs the movement of the lever arm 62 and the extensible rod 70. Thus, the spring-piston cylinder 64 prevents the dog carriage 26 from being damaged under these circumstances.

In operation, the high dog indexer 20 moves railway cars 22, FIG. 1, by engaging both sides of the bogey wheel truck frame 42 behind the railway wheel axles 44 with either high dogs 38 and 38A or high dogs 40 and 40A (not shown). The high dog indexer 20 is built to move the railway cars 22 in either direction along the railroad track 24.

The dog carriage 26, as shown in FIGS. 1 and 4, is at the indexer's most forward position in that if the dog carriage 26 is moved further forward, then roller 86 emerges from under dog house 59 and moves to the neutral position (FIG. 6). From this position, the dog carriage 26 is stuck with high dogs 38 and 40 on each side of the dog house 58. From the forward most position, the dog carriage 26 is reversed to engage the next truck frame 43. As the dog carriage 26 is reversed, the roller 68 and lever arm 62 return to the neutral position (FIG. 6) and the high dog 38 pivots to the lowered position. The high dog 40 remains in the lowered position as the roller 86 is held away from the high dog 40 by the dog house 58 or the lower portion 76 of the truck frame 42.

Reversing the dog carriage 26 further, frees roller 86 from beneath the truck frame 42 such that both rollers 68 and 86 and lever arms 62 and 82 are in the neutral position (FIG. 6) and the dogs 38 and 40 are in the lowered position. The dog carriage is reversed in this position until the roller 68 contacts the truck frame 43 on a lower portion or surface 77. This moves the roller 68 away from the dog 38 and locks the dog 38 into the lowered position. Reversing the dog carriage 26 further, engages the roller 86 with the lower portion 77 of truck frame member 43 to push the roller 86 and lever arm 82 toward and thereby raising dog 40. If the dog carriage 26 were reversed further, the train of railway cars 22 would be moved.

To move the railway cars 22 forward, the dog carriage 26 is moved to forward to engage the roller 68 with the lower portion 77. The roller 68 and lever arm 62 are pushed toward the dog 38 which is pivoted to the raised position to engage the truck frame 43 behind one of the railway wheel axles 45. The dog carriage 26 is moved forward by the motor 34 and chain 29 to move the railway cars 22 and position them for unloading over the bin chute 48. This completes a long stroke of the dog carriage 26.

To complete a short stroke, the dog carriage 26 pushes the railway cars 22 by the truck frame 43 to the forward most position (FIGS. 1 and 4). The dog carriage 26 is then reversed to truck frame 47 which is engaged by the dog carriage 26 and moved forward. Movement of the dog carriage 26 in long and short strokes is continued until all of the railway cars 22 have been unloaded.

The high dog indexer 20 of the present invention is a reversing high dog indexer in that the direction of travel of railway cars 22 may be in the forward or reverse direction. To move the railway cars 22 in the reverse direction, the high dog 40 is used to engage the truck frames in the same manner as the high dog 38. For example, moving the dog carriage 26 in the reverse direction toward the truck frame 43 engages the roller 86 under the lower portion 77 to move the roller 86 toward the high dog 40. This raises the high dog 40 to engage the truck frame 43 behind one of the railway wheel axles 45.

Reversing the dog carriage 26 further moves the railway cars 22 in the reverse direction. The dog carriage 26 reaches a reverse or rear most position when the roller 68 is under the dog house 58 and pushed away from the high dog 38 to maintain it in the lowered position. From this left most position the dog carriage 26 is pulled forward by the chain 29 and the lever arms 82 and 62 return to the neutral position (FIG. 6) until the roller 86 engages the lower portion 76 of truck frame 42. This holds the high dog 40 in the lowered position. Moving the dog carriage 26 forward further engages the roller 68 with the lower portion 76 of the truck frame 42 to raise the high dog 38.

To move the railway cars in the reverse direction, the dog carriage 26 is reversed to engage the roller 86 under the lower portion 76 of the truck frame 42 and raise the high dog 40 to engage the truck frame 42 behind one of the railway wheel axles 44. The dog carriage 26 continues in the reverse direction to move the railway cars 22 in the reverse direction. This completes a long stroke. A short stroke is done by moving the dog carriage 26 in the reverse direction to position the roller 68 under the dog house 58. The dog carriage 28 is moved to engage the dog carriage 26 with the truck frame 49. These long and short strokes are continued until all railway cars 22 have been positioned for unloading over the bin 48.

In another embodiment of the present invention, the dog carriage 26 includes only a single high dog, such as at 38, operated between a raised and a lowered position by a single lever arm 62. The high dog 40 and lever arm 82 with spring-piston cylinder 90 is removed from the dog carriage 26. In this embodiment, the high dog indexer is not reversing and only moves the railway cars in one direction. The number of strokes used to position the railway cars 22 over the bin chute 48 for unloading is a single stroke, such that the dog carriage 26 and high dog 38 engage, for example, the front most truck frames 42 and 47 for positioning the railway cars 22. The dog carriage 26 includes the high dog 38 and the lever arm 62 connected to the spring-piston cylinder 64 for operating the high dog 38 between the raised and lowered positions. Also, the dog carriage 26 is moved by the chain 29 and sprocket or gear 30 and 32 arrangement powered by a motor 34, such as an electric or hydraulic motor. Of course, either embodiment of the present invention may be used for moving any type of railway car for any purpose.

This invention has been described herein in considerable detail in order to comply with the patent statutes and to provide those skilled in the art with information needed to apply the novel principles and to construct and use such specialized components as are required. However, it is to be understood that the invention could be carried out by specifically different equipment and devices, and that various modifications, both as to the equipment details and operating procedures, can be accomplished without departing from the scope of the invention itself.

What is claimed is:

1. A dog carriage in a railway car indexer for engaging and moving a railway car which has a first railway wheel axle in a bogey wheel truck frame, said dog carriage comprising:

(a) a dog carriage frame;

(b) a first high dog pivotally attached to said dog carriage frame for pivoting between a first lowered position and a first raised position, wherein said first high dog is positioned to engage an upper end portion of the bogey wheel truck frame behind the first railway wheel axle in the first raised position; and (c) a first actuator for pivoting said first high dog between the first raised and the first lowered positions comprising rod means connected to said first dog and a directionally operated lever arm having a first end and a second end and being pivotally attached to said dog carriage frame therebetween and wherein the first end engages the railway car to pivot said lever arm and the second end is connected to said rod means for applying pivoting forces to said first high dog, wherein said red means comprises a rod slidably inserted in an outer casing which houses a first spring and a second spring separated by piston means connected to said rod for transferring forces between said rod and said outer casing.

2. The dog carriage as in claim 1 wherein said piston means comprises a rod piston attached to said rod and a floating piston slidably engaged on said rod wherein said first spring engages said rod piston and said outer casing and said second spring engages said floating piston and said outer casing such that said piston rod engages said floating piston to apply forces from said rod to said second spring and said outer casing.

3. The dog carriage as in claim 2 wherein said rod is connected to the second end of said lever arm and said outer casing is connected to said first dog.

4. The dog carriage as in claim 1 further comprising:

(a) a second high dog pivotally attached to said dog carriage frame for pivoting between a second lowered position and a second raised position, wherein said second high dog is positioned to engage an upper end portion of the bogey wheel truck frame behind a second railway wheel axle in the bogey wheel truck frame in the second raised position; and (b) a second actuator for pivoting said second high dog between the second raised and the second lowered positions said second actuator comprising rod means connected to said first dog and a directionally operated lever arm having a first end and a second end and being pivotally attached to said dog carriage frame therebetween and wherein the first end engages the railway car to pivot said lever arm and the second end is connected to said rod means for applying pivoting forces to said second high dog, wherein said rod means comprises a rod slidably inserted in an outer casing which houses a first spring and a second spring separated by piston means connected to said rod for transferring forces between said rod and said outer casing.

5. A railway car indexer for moving a railway car along a railroad track, said car having a first axle in a bogey frame, the railway car indexer comprising:

(a) a first dog carriage situated on a first side of the track for deploying a high dog for engaging an upper end portion of the bogey frame behind the first axle; and (b) a first mover mechanism for moving said first dog carriage to move the railway car along the railroad track;

(c) a second dog carriage situated on a second side of the track for deploying a high dog for engaging an upper end portion of the bogey frame behind the first axle and a second mover mechanism for moving said second dog carriage to move the railway car along the railroad track;

(d) wherein said first and second dog carriages are moved together by said first and second mover mechanisms to move the railway car in a given direction;

(e) wherein said first and second mover mechanisms each comprise a reversible prime mover connected to a sprocket engaging a chain connected to the respective dog carriage;

(f) wherein said first and second dog carriages each further comprise:

(1) a dog carriage frame;

(2) a high dog pivotally attached to said dog carriage frame for pivoting between a first lowered position and a first raised position, wherein said dog is positioned to engage an upper end portion of the bogey frame behind the first axle in the first raised position; and (3) an actuator for pivoting said dog between the first raised and the first lowered positions;

(g) wherein said actuator comprises rod means connected to said dog and a lever arm having a first end and a second end wherein said lever arm is pivotally attached to said dog carriage frame between the first and second ends and wherein the first end engages the railway car to pivot said lever arm and the second end is connected to said rod means for applying pivoting forces to said dog; and (h) wherein said rod means comprises a rod slidably inserted in an outer casing which houses a first spring and a second spring separated by piston means connected to said rod for transferring forces between said rod and said outer casing.

6. The indexer as in claim 5 wherein said piston means comprises a rod piston attached to said rod and a floating piston slidably engaged on said rod wherein said first spring engages said rod piston and said outer casing and said second spring engages said floating piston and said outer casing such that said rod piston engages said floating piston to apply forces from said rod to said second spring and said outer casing.

7. The indexer as in claim 6 wherein said rod is connected to the second end of said lever arm and said outer casing is connected to said first dog.

8. The indexer in claim 7 further comprising:

(a) a second high dog pivotally attached to said dog carriage frame for pivoting between a second lowered position and a second raised position, wherein said second dog is positioned to engage an upper end portion of the bogey frame behind a second axle in the bogey frame in the second raised position; and (b) a second actuator substantially identical to said first actuator for pivoting said second dog between the second raised and the second lowered positions.

9. A railway car indexer for moving a railway car along a railroad track, said car having a first axle in a bogey frame, the railway car indexer comprising:

(a) a first dog carriage situated on a first side of the track for deploying a high dog for engaging an upper end portion of the bogey frame behind the first axle; and (b) a first mover mechanism for moving said first dog carriage to move the railway car along the railroad track; and (c) wherein said first dog carriage comprises:

(1) a dog carriage frame;

(2) a first high dog pivotally attached to said dog carriage frame for pivoting between a first lowered position and a first raised position, wherein said first dog is positioned to engage the bogey frame behind the first axle in said first raised position; and (3) a first actuator for pivoting said first dog between said first raised and said first lowered positions;

(d) wherein said first actuator comprises rod means connected to said first dog and a lever arm having a first end and a second end wherein said lever arm is pivotally attached to said dog carriage frame between the first and second ends and wherein the first end engages the railway car to pivot said lever arm and move the second end which is connected to said rod means for applying pivoting forces to said first dog;

(e) wherein said rod means comprises a rod slidably inserted in an outer casing which houses a first spring and a second spring separated by piston means connected to said rod for transferring forces between said rod and said outer casing.

10. The indexer as in claim 9 wherein said piston means comprises a rod piston attached to said rod and a floating piston slidably engaged on said rod wherein said first spring engages said rod piston and said outer casing and said second spring engages said floating piston and said outer casing, wherein said rod piston engages said floating piston to apply forces from said rod to said second spring and said outer casing.

11. The indexer as in claim 10 wherein said rod is connected to the second end of said lever arm and said outer casing is connected to said first dog.

12. The dog carriage as in claim 11 further comprising:

(a) a second high dog pivotally attached to said dog carriage frame for pivoting between a second lowered position and a second raised position, wherein said second dog is positioned to engage an upper end portion of the bogey frame behind a second axle in the bogey frame in the second raised position; and (b) a second actuator substantially identical to said first actuator for pivoting said second dog between the second raised and the second lowered positions.

13. The indexer as in claim 11 wherein said first mover mechanism comprises a reversible prime mover connected to a sprocket which is meshed with a chain connected to said first dog carriage slidably engaged in a dog carriage track.

* * * * *